US006622637B2

(12) United States Patent
Cummins

(10) Patent No.: US 6,622,637 B2
(45) Date of Patent: Sep. 23, 2003

(54) ARCUATE TILTING MECHANISM FOR HIGH SPEED TRAINS

(76) Inventor: Richard Cummins, 33 Harmony Cir., Orchard Park, NY (US) 14027

( * ) Notice: Subject to any disclaimer, the term of this patent is extended or adjusted under 35 U.S.C. 154(b) by 0 days.

(21) Appl. No.: 10/205,487

(22) Filed: Jul. 25, 2002

(65) Prior Publication Data

US 2003/0066454 A1 Apr. 10, 2003

Related U.S. Application Data

(60) Provisional application No. 60/308,085, filed on Jul. 26, 2001.

(51) Int. Cl.[7] ..... B61F 5/00

(52) U.S. Cl. ..... 105/199.2; 105/199.1; 105/141; 104/124

(58) Field of Search ..... 104/124, 125, 104/118; 105/141, 165, 167, 199.1, 199.2, 330, 455

(56) References Cited

U.S. PATENT DOCUMENTS 2,417,526 A * 3/1947 Steins ..... 105/164
2,960,941 A * 11/1960 Li ..... 105/164
5,653,173 A * 8/1997 Fischer ..... 104/124

* cited by examiner

*Primary Examiner*—Mark T. Le
(74) *Attorney, Agent, or Firm*—Sofer & Haroun, LLP

(57) ABSTRACT

The present invention is directed to an arcuate tilting mechanism for use with a vehicle having a passenger compartment and a carriage traveling on a track where the mechanism comprises an arcuate roller gear divider mounted on the underside of the passenger compartment. An outer carriage roller track is mounted on the upper side of the carriage, so that the arcuate roller gear divider and the outer carriage roller track are in juxtaposed arcuate relation. A first set of roller gears is provided which engage the arcuate roller gear divider and the outer carriage roller track so that when the vehicle enters a turn, the passenger compartment can be angled into the radius of the turn, where the carriage remains parallel to the track.

10 Claims, 4 Drawing Sheets

ARCUATE TILTING MECHANISM FOR HIGH SPEED TRAINS

RELATED APPLICATION

This application is based on and claims priority to U.S. Provisional Patent Application 60/308,085 filed Jul. 26, 2001, entitled "Arcuate Tilting Mechanism for High Speed Trains" the entirety of which is incorporated herein by reference.

FIELD OF INVENTION

The present invention is directed to high speed trains. More specifically, the present invention is directed to a tilting mechanism which forms the interface between the train carriage and compartment, and allows the compartment to move in an arcuate fashion.

BACKGROUND

The necessity for providing a tilting mechanism for high-speed trains is well known. In order to service the ever-growing demands of the commuting population, railway operators are increasingly turning to the use of high speed trains to reduce running times. This is a particularly attractive option as these high speed trains are adaptable for use on existing rail lines, which avoids the costly alternative of building dedicated high speed train lines. However, existing lines are replete with bends and curves that bear high radii, which are suitable for slower speed trains, but pose a serious detriment to their high speed counterparts due to the increased discomfort felt by passengers when these high radius curves are taken at greater speeds. This discomfort is the result of turning forces, comprised basically of gravity and a centrifugal force, whose vector combination produces a resultant force, which translates in passenger terms, to the passenger being pushed into the seat and to the side. Furthermore, this discomfort is compounded by the psychological anxiety caused by these turning forces. It is a normal human reaction upon feeling such forces, especially in significant amounts, to fear that the rail car will be thrown off the track as a result of taking a curve at a high speed. This is an unsubstantiated fear, as the force required to lift the train off the tracks would be many times that experienced at operating speeds, nevertheless, this psychological anxiety must be taken into account when dealing with high speed trains.

Tilting trains assuage these discomforts and anxieties by tilting the passenger compartment unit of the train so that the resultant forces felt by the passenger, are aligned with the gravitational force normally felt. In other words, the resultant forces become only a stronger gravitational force, thereby causing the passenger to just feel pulled down into the seat when the train takes a curve at a high speed, which causes much less anxiety and discomfort.

Previous tilting mechanisms employed massive pivoting trunions and resulted in unfavorable load concentrations. Furthermore, previous mechanisms shifted the weight of the compartment toward the outer rail of the curve, rather than the inner rail, thus greatly decreasing the stability of both the compartment and the carriage with respect to the rails. Prior art mechanisms have also used an elevated pivot located on the centerline of the carriage, which results in the train being supported at a greater, and therefore more unstable, height. Thus, there exists a need for a tilting mechanism for use in high speed trains that resolves the aforementioned issues and increases the overall stability of a train taking high radii curves at a greater speed.

SUMMARY OF INVENTION

The present invention is directed to an arcuate tilting mechanism for use with a vehicle having a passenger compartment and a carriage traveling on a track where the mechanism comprises an arcuate roller gear divider mounted on the underside of the passenger compartment. An outer carriage roller track is mounted on the upper side of the carriage, so that the arcuate roller gear divider and the outer carriage roller track are in juxtaposed arcuate relation. A first set of roller gears is provided which engage the arcuate roller gear divider and the outer carriage roller track so that when the vehicle enters a turn, the passenger compartment can be angled into the radius of the turn, where the carriage remains parallel to the track.

BRIEF DESCRIPTION OF FIGURES

In the drawings, wherein like reference numbers denote similar elements throughout the several views:

FIG. 4*b* illustrates a cross-sectional view of line A—A on the roller-gear divider from FIG. 4*a.

DETAILED DESCRIPTION OF THE PREFERRED EMBODIMENT

Figure 1:
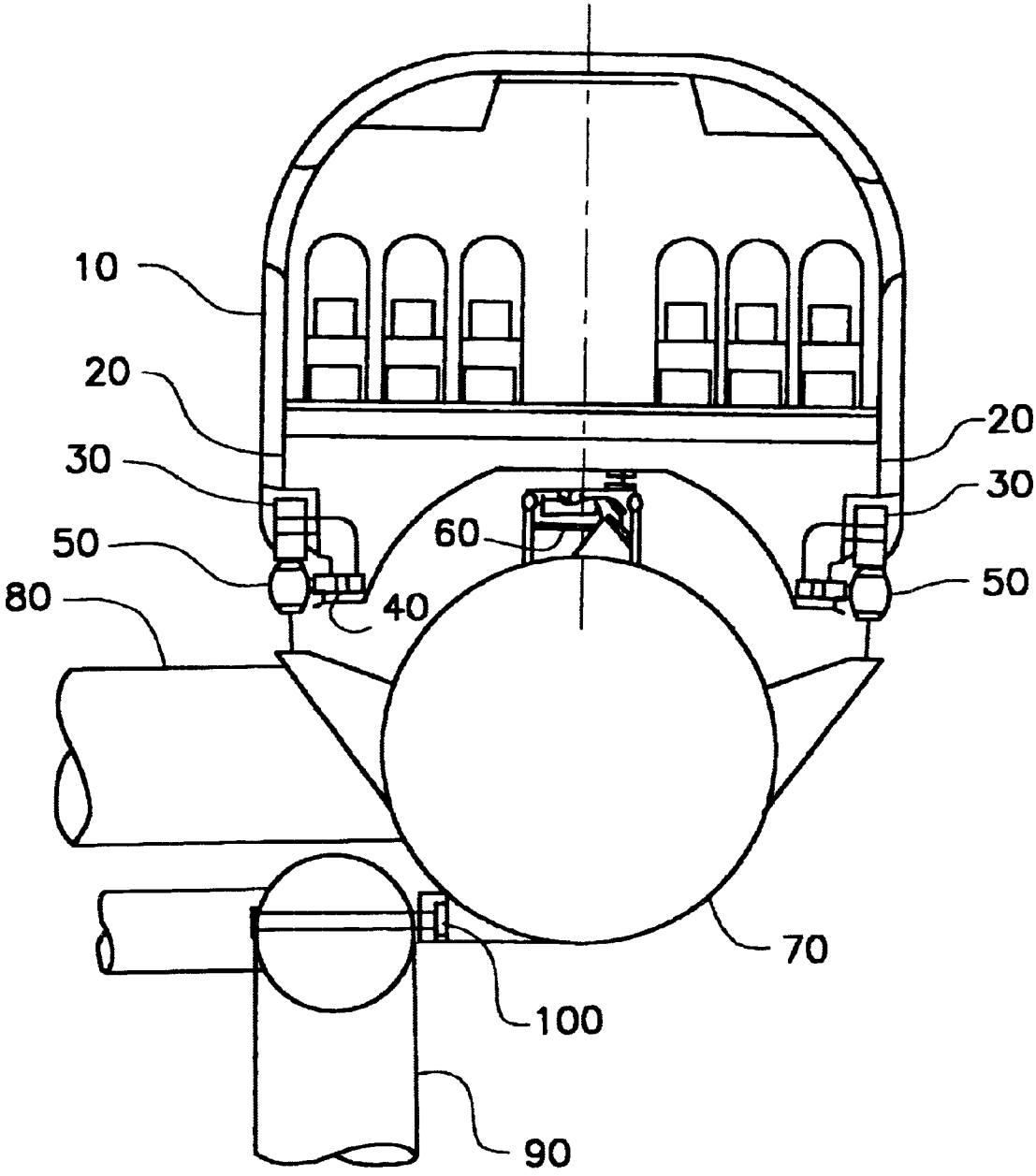
FIG. 1 is a cross-sectional front elevation of a high speed train, in accordance with one embodiment of the present invention.

In one embodiment of the present invention, as illustrated in FIG. 1, an air propelled or soft track vehicle 1, such as a high speed train, having an arcuate tilting mechanism is provided for moving passengers along a pressurized guide way tube 70. Vehicle 1 is comprised of a passenger compartment 10, carriage 20, carriage main wheels 30, and carriage guide wheels 40. Attached to tube 70, tire or soft track 50 is configured to support carriage main wheels 30 and carriage guide wheels 40. An air propulsion assembly 60 is mounted on the upper surface of tube 70 between the top of tube 70 and the underside of compartment 10 and carriage 20 configured to provide a means for using air to propel vehicle 1 along track 50. Cross flow tube 80 is attached to guide way tube 70 and configured to provide air to air propulsion assembly 60. Stanchion tube 90 and stanchion wheel guide way supports 100 are configured to support guide way tube 70 and tracks 50.

It should be noted that air propulsion assembly 60 is provided as one example of a possible propulsion assembly for use with vehicle 1 and is in no way intended to limit the scope of the present invention. For example, magnetic, electric or any other propulsion system capable of propelling vehicle 1 along a set of tracks which employs a similar arcuate tilting mechanism is within the contemplation of the present invention.

As discussed above, compartment 10 is provided with an arcuate tilting mechanism for tilting compartment 10 relative to carriage 20. As compartment 10 and carriage 20 approach an angled portion of guide way tube 70, compartment 10 is tilted into the angle relative to carriage 20 so as to counteract the centripetal forces of compartment 10 provided by track 50 as it goes around the turn, allowing compartment 10 to proceed more quickly and stably through the turn.

Figure 2B:
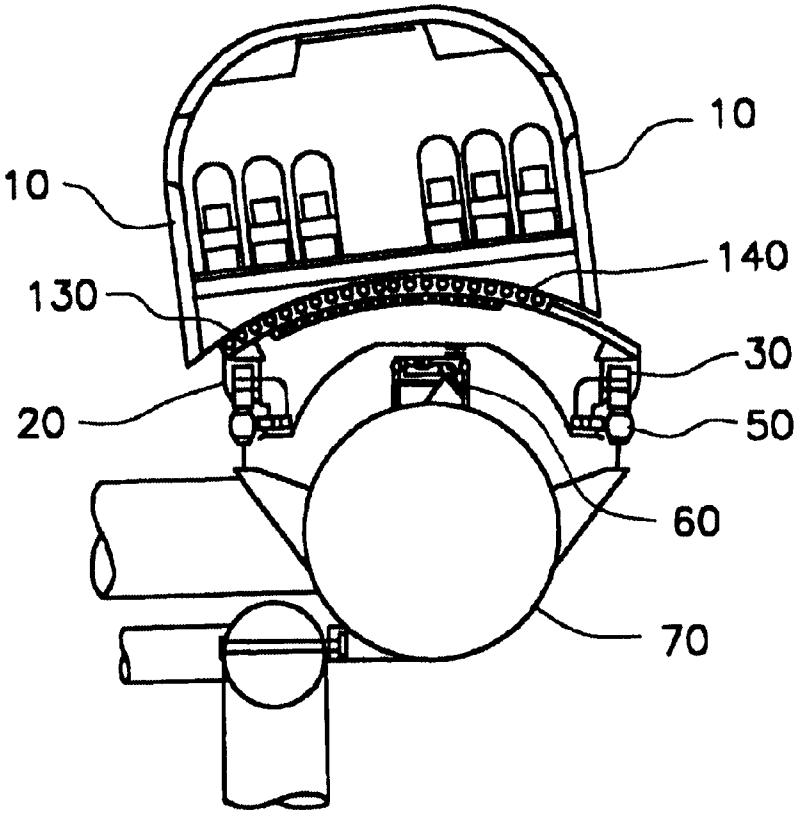
FIG. 2*b* is a cross-sectional front elevation of a high speed train from FIG. 1, in accordance with one embodiment of the present invention.
Figure 2A:
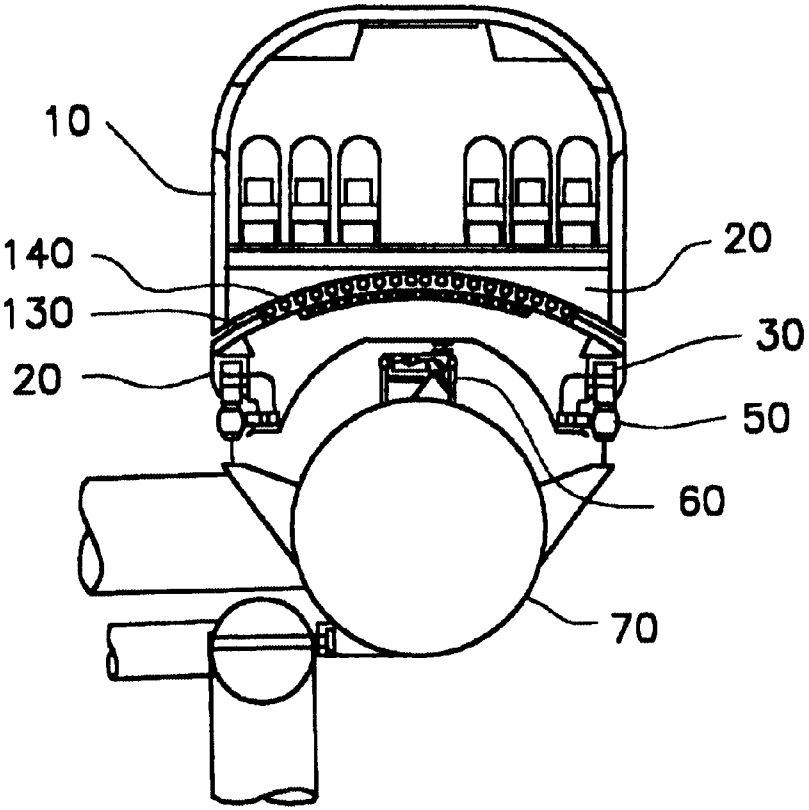
FIG. 2*a* is a cross-sectional front elevation of a high speed train from FIG. 1, in accordance with one embodiment of the present invention.

In one embodiment of the present invention, as illustrated in FIG. 2*a*, the arcuate tilting mechanism is provided, disposed between compartment 10 and carriage 20 designed to facilitate movement relative to one another. To this end, an arcuate rail 130 is provided, disposed across the width of carriage 20.

It should be noted that one arcuate rail 130 is discussed above as illustrative of this embodiment, however this in no way is intended to limit the scope of the present invention. A series of arcuate rails 130 may be disposed in parallel along the length of carriage 20, each arcuate rail 130 running across the width of carriage 20 for the length of compartment 10.

In one embodiment of the present invention as illustrated in FIG. 2*b*, vehicle wheels 140 are mounted on the under side of compartment 10 and are configured to engage arcuate rail 130 on compartment 10. As compartment 10 and carriage 20 approach an angled portion of tube 70, vehicle wheels 140 operate against arcuate rail 130 affecting a tilting of compartment 10 relative to carriage 20 such that the weight of compartment 10 is tilted into the angle of turn in tube 70, thus countering the centripetal forces caused by compartment 10 moving around the angled portion of tube 70.

Figure 3B:
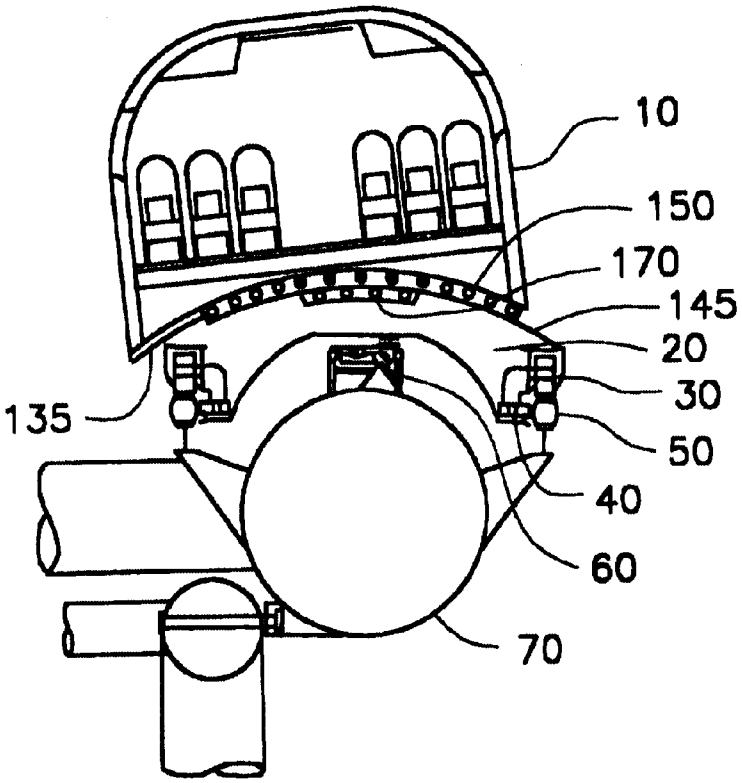
FIG. 3*b* is a cross-sectional front elevation of a high speed train employing a roller gear divider from FIG. 1, in accordance with one embodiment of the present invention.
Figure 3A:
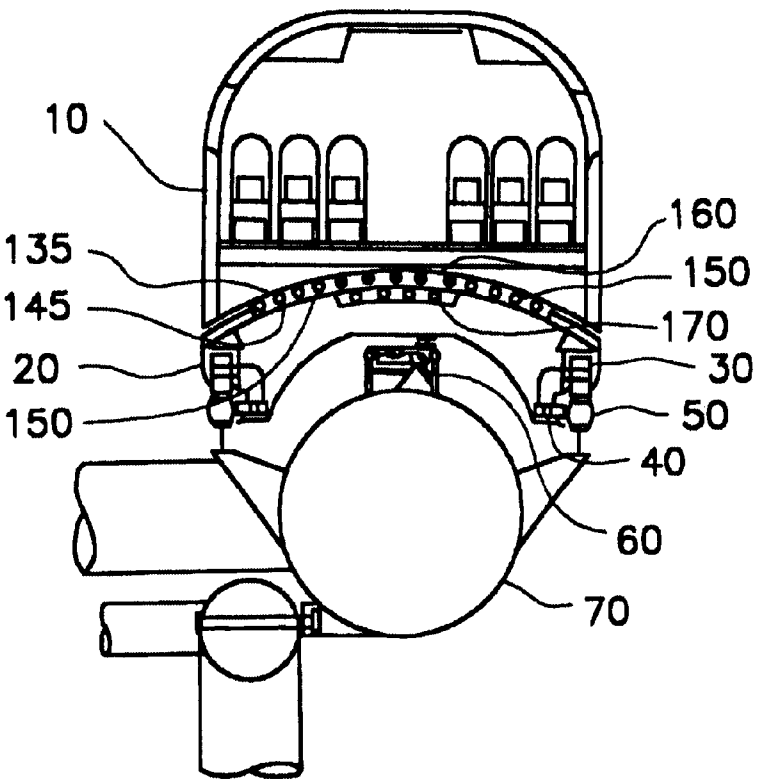
FIG. 3*a* is a cross-sectional front elevation of a high speed train employing a roller gear divider from FIG. 1, in accordance with one embodiment of the present invention.

In another embodiment of the present invention, as illustrated in FIG. 3*a*, compartment 10 maintains an arcuate roller gear divider 135. Roller gear divider 135 is disposed on the under side and runs across the width of compartment 10. An outer carriage roller track 145 is provided, disposed opposite and running parallel to roller gear divider 135 on carriage 20, It should be noted that a single configuration of roller gear divider 135 and outer carriage roller track 145 is discussed as a single assembly, however, this is in no way intended to limit the scope of the present invention. For example, a series of roller gear dividers 135 and outer carriage roller tracks 145 may be disposed in parallel along the length of carriage 20, each divider 135 and track 145 running across the width of carriage 20 and compartment 10 for the length of compartment 10.

As illustrated in FIG. 3*a,* a series of outer roller wheels 150 are disposed at either end of and between roller gear divider 135 and carriage roller track 145 such that wheels 150 provide a buffer between compartment 10 and carriage 20 near their sides respectively. Disposed between outer roller wheels 150 (on the outer ends of compartment 10 and carriage 20) a series of roller gears 160 are positioned between roller gear divider 135 and outer carriage roller track 145.

A series of hold down wheels 170 are disposed on carriage roller track 145 in the center of carriage 20 and are configured to hold compartment 10 and the related arcuate tilting systems to carriage 20.

In one embodiment of the present invention, as illustrated in FIG. 3*b*, as compartment 10 approaches a curve or angle in pressurized guide tube 70, compartment 10 tilts inward towards the curve relative to carriage 20 so as to counterbalance the centripetal forces caused by rail 50. As illustrated, roller gears 160 engage roller gear divider 135 on compartment 10, and outer carriage roller track 145 on carriage 20 so as to rotate compartment 10 into the curve, while hold down wheels 170 stabilize the connection and prevent compartment 10 from separating from carriage 20.

When engaged, roller gears 160 move roller gear divider 135 is moved at a rate of ½ the distance of compartment 10 such that compartment 10 can be moved twice the distance towards the center of curvature before divider 135 and roller wheels 150 are exposed into the air stream. Roller wheels 150, disposed on either side of roller gears 160, support the weight of compartment 10 during its arcuate motion.

Figure 4A:
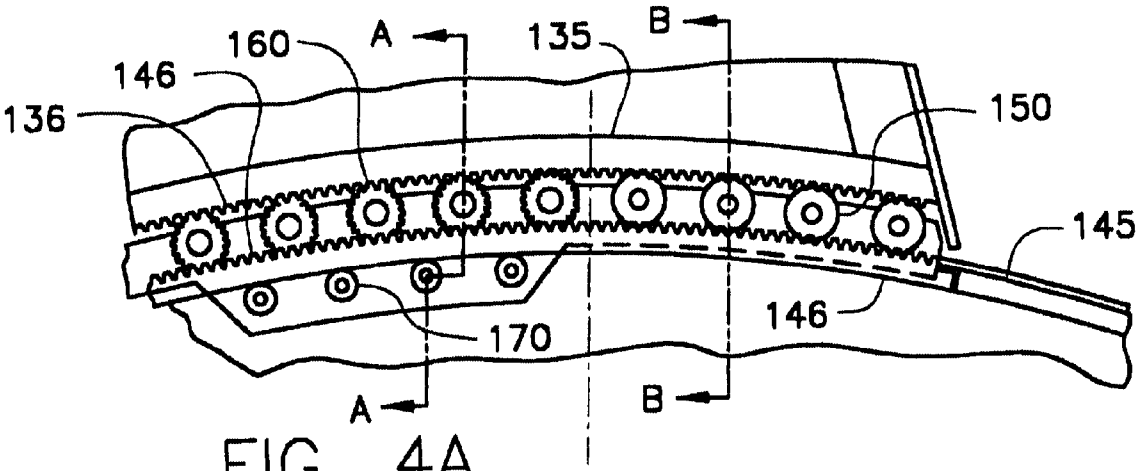
FIG. 4*a* is a close up cross-sectional elevation of a the roller-gear divider from FIG. 3, in accordance with one embodiment of the present invention.

A more detailed view of roller gear divider 135 and carriage roller track 145 is illustrated in FIG. 4*a*. In one embodiment of the present invention, as illustrated in FIG. 4*a*, roller gear divider 135, attached to compartment 10, is provided with an upper gear toothed flange 136 and outer carriage roller track 145, attached to carriage 20, is provided with a lower gear toothed flange 146.

Upper gear toothed flange 136 and lower gear tooth flange 146 are located in the center of the divider 135 and roller track 145 respectively such that they can engage roller gears 160. At the same time roller wheels 150 are of such a configuration that when passing over upper gear tooth flange 136 of divider 135 and lower gear tooth flange 146 of track 145 they do not interfere, allowing wheels 150 to pass smoothly between divider 135 and track 145.

Figure 4C:
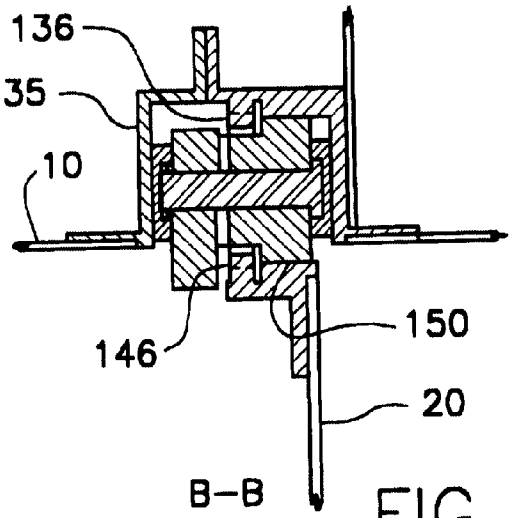
* and FIG. 4*c* illustrates a cross-sectional view of line B—B on the roller-gear divider from FIG. 4*a.*
Figure 4B:
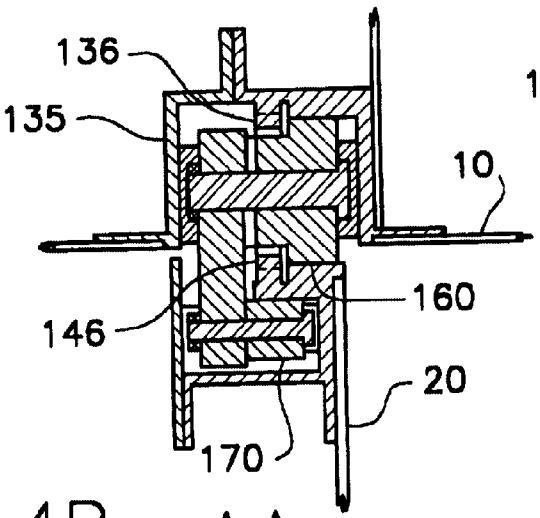

FIG. 4*b* illustrates a cross section of roller gear divider, roller gears 160 and carriage roller track 145. The teeth of roller gears 160 engage upper gear tooth flange 135 and lower gear tooth flange 146 so as to actuate the arcuate movement of compartment 10 relative to carriage 20. As discussed above, upper gear flange 136 of roller divider 135 moves at rate of ½ relative to the carriage such that compartment 10 is exposed twice as far (relative to the roller wheel only embodiment of FIG. 2*b*) before roller wheels 150 are exposed into the air stream. As illustrated in FIG. 4*c,* which shows cross section B—B from FIG. 4*a,* roller wheels 150 are free to support the weight of and facilitate arcuate movement of compartment 10 without interference from upper or lower toothed flanges 136 and 146.

In this configuration, present invention allows compartment 10 to rotate in an arcuate motion into the radius of the turn shifting the weight of the train compartment on carriage 20 toward inner track 50 rather than the outer track as is common in much of the prior art. This increases the stability and smoothness of both compartment 10 and carriage 20 with respect to track 50 and also better counters centripetal forces associated with older trains reducing the anxiety felt by passengers in high speed trains.

Another advantage of the present invention is that roller gear divider 135 as actuated by roller gears 160 reduces the amount of wheel 150 and divider 135 material which enters the air flow when compartment 10 moves into a curve on tube 70. This allows the air, moving at high speeds to pass quickly over the smooth under side curved skin of compartment 10, as well as the smooth upper skin, reducing wind resistance and making the train more efficient.

Yet another advantage of the present invention, is that the arcuate tilting mechanism which is disposed across the width of carriage 20 and compartment 10 is low in profile, particularly compared to centerline tilting mechanisms which raise the center of gravity for the overall train. The arcuate design of the present invention, maintains a low profile lowering the center of gravity, increasing stability of the vehicle and carriage on both straight and curved tube 70 portions as well as reducing the risk of carriage 20—compartment 10 separation.

In addition to providing a low center of gravity, this configuration of distributing the arcuate tilting mechanism across the entire width of carriage 20 and compartment 10 utilizes existing structures to support the weigh of the tilting mechanism eliminating the need for massive pivoting trunnions eliminating the need for unnecessary weight increasing efficiency and reducing the overall cost of production.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

What is claimed is:

1. An arcuate tilting mechanism for use with a vehicle traveling on a track, the vehicle having a passenger compartment and a carriage, the mechanism comprising:

an arcuate roller gear divider mounted on the underside of the passenger compartment;

an outer carriage roller track mounted on the upper side of the carriage, so that said arcuate roller gear divider and said outer carriage roller track are in juxtaposed arcuate relation; and a first set of roller gears which engage said arcuate roller gear divider and said outer carriage roller track so that when the vehicle enters a turn, the passenger compartment can be angled into the radius of the turn, wherein the carriage remains parallel to the track.

2. The arcuate tilting mechanism as claimed in claim 1, further comprising a pressurized guide tube for supporting the track.

3. The arcuate tilting mechanism as claimed in claim 2, further comprising an air propulsion assembly coupled to said pressurized guide tube configured to propel the vehicle along the track.

4. The arcuate tilting mechanism as claimed in claim 1, further comprising a first set of roller wheels positioned between said outer carriage roller track and said arcuate roller gear divider on a first side of said roller gears, configured to support the weight of the passenger compartment on the carriage during tilting.

5. The arcuate tilting mechanism as claimed in claim 4, further comprising a second set of roller wheels positioned between said outer carriage roller track and said arcuate roller gear divider on a second side of said roller gears opposite said first side, configured to support the weight of the passenger compartment on the carriage during tilting.

6. The arcuate tilting mechanism as claimed in claim 1, further comprising hold down wheels disposed on the underside of the outer carriage roller track in the center of carriage and configured to hold the compartment and the arcuate tilting mechanism to the carriage.

7. The arcuate tilting mechanism as claimed in claim 1, wherein said arcuate roller gear divider further comprises a upper gear toothed flange.

8. The arcuate tilting mechanism as claimed in claim 7, wherein said first set of roller gears engages said upper gear tooth flange of said arcuate roller gear divider to tilt the compartment relative to the carriage.

9. The arcuate tilting mechanism as claimed in claim 8, wherein said an outer carriage roller track further comprises a lower gear toothed flange.

10. The arcuate tilting mechanism as claimed in claim 9, wherein said first set of roller gears drives against said lower gear tooth flange of said arcuate roller gear divider so as to move said upper gear toothed flange of said arcuate roller gear divider to tilt the compartment relative to the carriage.

* * * * *